US006957884B2

(12) United States Patent
Sharma et al.

(10) Patent No.: US 6,957,884 B2
(45) Date of Patent: Oct. 25, 2005

(54) HIGH-SPEED INKJET PRINTING FOR VIBRANT AND CROCKFAST GRAPHICS ON WEB MATERIALS OR END-PRODUCTS

(75) Inventors: Varunesh Sharma, Atlanta, GA (US); Alice Susan Gordon, Roswell, GA (US); Lee Kirby Jameson, Roswell, GA (US); Phillip Andrew Schorr, Atlanta, GA (US); Allen James Dohnalik, Depere, WI (US)

(73) Assignee: Kinberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/330,515

(22) Filed: Dec. 27, 2002

(65) Prior Publication Data

US 2004/0125184 A1 Jul. 1, 2004

(51) Int. Cl.[7] ..... B41J 2/01
(52) U.S. Cl. ..... 347/99; 347/88
(58) Field of Search ..... 347/99, 88, 100, 347/101, 94; 101/1, 465; 106/31.16, 31.13

(56) References Cited

U.S. PATENT DOCUMENTS

| | | | |
|---|---|---|---|
| 3,338,992 | A | 8/1967 | Kinney |
| 3,341,394 | A | 9/1967 | Kinney |
| 3,502,763 | A | 3/1970 | Hartmann |

(Continued)

FOREIGN PATENT DOCUMENTS

| | | |
|---|---|---|
| DE | 2313335 | 1/1975 |
| DE | 2340855 | 6/1975 |
| DE | 2654823 | 6/1978 |

(Continued)

OTHER PUBLICATIONS

RD 173017, Sep. 10, 1978, (abstract).

Pond, Stephen F., "Ink Jet Technology and Product Development Strategies," Published by © 2000 Torrey Pines Research, pp. 198–201, 377–385.

(Continued)

*Primary Examiner*—Manish S. Shah
(74) *Attorney, Agent, or Firm*—William D. Letson; Steven D. Flack; Richard M. Shane

(57) ABSTRACT

A method of creating high-speed multi-color process images. The method includes providing at least two high operating frequency printheads which are capable of processing phase-change inks, providing at least two phase-change inks, providing a substrate, activating the printheads such that at least two inks pass therethrough, and passing the substrate under the printheads at a rate of at least about 1000 feet per minute so as at least one process image is formed on the substrate. The present invention also includes a process for achieving high-speed crockfast process printing on a material with phase-change ink. The process includes providing at least an array of printheads capable of processing phase-change inks at frequencies of at least about 20 kHz, providing a material, providing a material transport system capable of transporting the material under the printheads, providing a plurality of phase-change inks, transporting material under the array printheads at a speed of at least 1000 ft/min, and ejecting ink from at least two of the printheads onto the material so as to form an image.

24 Claims, 1 Drawing Sheet

U.S. PATENT DOCUMENTS 3,542,615 A 11/1970 Dobo et al.
3,692,618 A 9/1972 Dorschner et al.
3,802,817 A 4/1974 Matsuki et al.
RE28,219 E 10/1974 Taylor et al.
3,849,241 A 11/1974 Butin et al.
3,855,046 A 12/1974 Hansen et al.
3,868,728 A 3/1975 Krzewinski
4,041,203 A 8/1977 Brock et al.
4,171,542 A 10/1979 Cox et al.
4,303,924 A 12/1981 Young, Jr.
4,340,563 A 7/1982 Appel et al.
4,374,888 A 2/1983 Bornslaeger
4,382,262 A 5/1983 Savit
4,389,503 A 6/1983 Maxwell et al.
4,389,734 A 6/1983 Franz et al.
4,478,910 A 10/1984 Oshima et al.
4,503,444 A 3/1985 Tacklind
4,504,357 A 3/1985 Holbein et al.
4,504,977 A 3/1985 King et al.
4,526,825 A 7/1985 Whitehead
4,535,481 A 8/1985 Ruth-Larson et al.
4,689,078 A 8/1987 Koike et al.
4,752,972 A 6/1988 Neckerman et al.
4,786,288 A 11/1988 Handa et al.
4,835,208 A 5/1989 Ball
4,841,310 A * 6/1989 Hoffman ..... 347/94
4,849,770 A 7/1989 Koike et al.
4,909,879 A 3/1990 Ball
4,969,951 A 11/1990 Koike et al.
4,991,232 A 2/1991 Taylor
5,003,902 A 4/1991 Benstock et al.
5,019,066 A 5/1991 Freeland et al.
5,087,283 A 2/1992 Dixon et al.
5,116,682 A 5/1992 Chakravarti et al.
5,145,727 A 9/1992 Potts et al.
5,151,321 A 9/1992 Reeves et al.
5,169,706 A 12/1992 Collier, IV et al.
5,178,931 A 1/1993 Perkins et al.
5,188,885 A 2/1993 Timmons et al.
5,195,950 A 3/1993 Delannoy
5,213,881 A 5/1993 Timmons et al.
5,214,442 A 5/1993 Roller
5,271,883 A 12/1993 Timmons et al.
5,280,310 A 1/1994 Otsuka et al.
5,371,520 A 12/1994 Kubota
5,444,871 A 8/1995 Lopez
5,458,590 A 10/1995 Schleinz et al.
5,461,724 A 10/1995 Wiedner et al.
5,464,688 A 11/1995 Timmons et al.
5,466,232 A 11/1995 Cadieux et al.
5,481,281 A 1/1996 Otsuka et al.
5,487,614 A 1/1996 Hale
5,503,076 A 4/1996 Yeo
5,538,550 A 7/1996 Yaegashi et al.
5,562,037 A * 10/1996 Schleinz et al. ..... 101/483
5,563,642 A 10/1996 Keefe et al.
5,566,616 A 10/1996 Schleinz et al.
5,571,586 A 11/1996 Gobran
5,586,339 A 12/1996 Lathan
5,591,153 A 1/1997 Mattingly, III
5,594,955 A 1/1997 Sommers
5,597,642 A 1/1997 Schleinz et al.
5,628,067 A 5/1997 Meyer et al.
5,629,063 A 5/1997 Gobran
5,648,805 A 7/1997 Keefe et al.
5,670,004 A 9/1997 Mattingly, III
5,673,433 A 10/1997 Rothrum
5,681,645 A 10/1997 Strack et al.
5,694,739 A 12/1997 Mattingly, III
5,695,855 A 12/1997 Yeo et al.
5,695,868 A 12/1997 McCormack
5,705,251 A 1/1998 Morman et al.
5,720,738 A 2/1998 Clark
5,755,906 A 5/1998 Achter et al.
5,759,673 A 6/1998 Ikezawa et al.
5,762,642 A 6/1998 Coles et al.
5,769,837 A 6/1998 Parr
5,784,279 A 7/1998 Barlage, III et al.
H1746 H 8/1998 Carrier et al.
5,793,398 A * 8/1998 Hennig ..... 347/88
5,797,894 A 8/1998 Cadieux et al.
5,807,365 A 9/1998 Luceri
5,843,254 A 12/1998 Clark
5,851,274 A 12/1998 Lin
5,851,595 A 12/1998 Jones, Jr.
5,853,859 A 12/1998 Levy et al.
5,855,999 A 1/1999 McCormack
5,895,505 A 4/1999 Yamamoto et al.
5,919,539 A 7/1999 Bisbis et al.
5,931,824 A 8/1999 Stewart et al.
5,972,082 A 10/1999 Koyano et al.
5,985,396 A 11/1999 Kerins et al.
6,013,347 A 1/2000 Martin et al.
6,020,405 A 2/2000 Matzinger et al.
6,024,220 A 2/2000 Smith et al.
6,033,065 A 3/2000 Ikezaki
6,037,281 A 3/2000 Mathis et al.
6,050,666 A 4/2000 Yeoh et al.
6,051,036 A 4/2000 Kusaki et al.
6,096,412 A 8/2000 McFarland et al.
6,103,364 A 8/2000 Harris et al.
6,106,922 A 8/2000 Cejka et al.
6,120,888 A 9/2000 Dolsey et al.
6,132,858 A 10/2000 Kloos
6,141,799 A 11/2000 Morris
6,142,984 A 11/2000 Brown et al.
6,146,770 A 11/2000 Sargeant et al.
6,149,259 A 11/2000 Otsuka et al.
6,150,005 A 11/2000 Williams et al.
6,159,581 A 12/2000 Yoneda et al.
6,183,587 B1 2/2001 McFall et al.
6,199,968 B1 3/2001 Katakura et al.
6,231,652 B1 5/2001 Koyano et al.
6,235,098 B1 * 5/2001 Maekawa et al. ..... 106/31.61
6,235,659 B1 5/2001 McAmish et al.
6,245,410 B1 6/2001 Hahnle et al.
6,254,582 B1 7/2001 O'Donnell et al.
6,258,427 B1 7/2001 Kerins et al.
6,263,816 B1 7/2001 Codos et al.
6,265,053 B1 7/2001 Kronzer et al.
6,266,436 B1 7/2001 Bett et al.
H1978 H 8/2001 Freiburger et al.
6,276,790 B1 * 8/2001 Ikezaki ..... 347/88
6,286,144 B1 9/2001 Henderson et al.
6,316,688 B1 11/2001 Hammons et al.
6,328,793 B1 * 12/2001 Malhotra et al. ..... 106/31.43
6,395,957 B1 5/2002 Chen et al.
6,497,789 B1 * 12/2002 Hermans et al. ..... 162/205
6,530,090 B1 3/2003 Ambrose et al.
6,539,866 B1 * 4/2003 Osawa et al. ..... 101/465
6,699,360 B2 * 3/2004 Heath et al. ..... 162/111
2001/0053643 A1 12/2001 McAmish et al.
2002/0007834 A1 1/2002 Trotter et al.
2002/0060728 A1 5/2002 Koizumi et al.
2002/0075343 A1 6/2002 Classens et al.
2003/0079272 A1 5/2003 Poppe

FOREIGN PATENT DOCUMENTS

DE 2412852 5/1979
DE 19803827 8/1999
DE 19810847 9/1999

| | | | | |
|---|---|---|---|---|
| DE | 19810849 | | 5/2000 | |
| EP | 0 023 433 | A2 | 2/1981 | |
| EP | 0 211 524 | B1 | 9/1991 | |
| EP | 0575204 | A2 * | 6/1993 | ..... B41J/2/04 |
| EP | 0 336 043 | | 7/1993 | |
| EP | 0 571 127 | | 11/1993 | |
| EP | 0 304 957 | B1 | 4/1994 | |
| EP | 0 639 459 | A2 | 2/1995 | |
| EP | 0 713 774 | A2 | 5/1996 | |
| EP | 0 471 384 | B1 | 10/1996 | |
| EP | 0 747 029 | A1 | 12/1996 | |
| EP | 0 805 027 | A2 | 11/1997 | |
| EP | 0 604 729 | B1 | 3/1998 | |
| EP | 0 809 680 | B1 | 12/1998 | |
| EP | 1 059 340 | A1 | 12/2000 | |
| EP | 1 070 596 | A2 | 1/2001 | |
| EP | 0 777 008 | | 4/2001 | |
| EP | 1 164 007 | A1 | 12/2001 | |
| EP | 1 186 431 | A2 | 3/2002 | |
| EP | 0 861 154 | B1 | 4/2002 | |
| EP | 1 062 095 | B1 | 6/2002 | |
| EP | 1 224 876 | | 7/2002 | |
| EP | 0 764 550 | B1 | 11/2002 | |
| FR | 2741296 | | 5/1997 | |
| GB | 2 128 439 | | 4/1984 | |
| GB | 2 334 684 | | 9/1999 | |
| JP | 55-051 583 | A2 | 4/1980 | |
| JP | 57-115 352 | A2 | 7/1982 | |
| JP | 60-104 076 | A2 | 6/1985 | |
| JP | 85-027 588 | B | 6/1985 | |
| JP | 60-169 489 | A2 | 9/1985 | |
| JP | 60-245 557 | A2 | 12/1985 | |
| JP | 61-118 473 | A2 | 6/1986 | |
| JP | 61-179 269 | A2 | 8/1986 | |
| JP | 61-179 271 | A2 | 8/1986 | |
| JP | 61-179 272 | A2 | 8/1986 | |
| JP | 61-179 273 | A2 | 8/1986 | |
| JP | 63-265 680 | A2 | 11/1988 | |
| JP | 01-013 518 | A2 | 1/1989 | |
| JP | 03-104 646 | A2 | 5/1991 | |
| JP | 03-049 311 | B4 | 7/1991 | |
| JP | 92-015 746 | B | 3/1992 | |
| JP | 04-251 747 | A | 9/1992 | |
| JP | 04-292 947 | A2 | 10/1992 | |
| JP | 05-035 191 | B4 | 5/1993 | |
| JP | 05-230 409 | A2 | 9/1993 | |
| JP | 05-247 390 | A2 | 9/1993 | |
| JP | 05-331 396 | A2 | 12/1993 | |
| JP | 06-127 032 | A2 | 5/1994 | |
| JP | 06-246 934 | A2 | 9/1994 | |
| JP | 06-286 134 | A2 | 10/1994 | |
| JP | 06-312 509 | A2 | 11/1994 | |
| JP | 07-034 019 | A2 | 2/1995 | |
| JP | 07-068 922 | A2 | 3/1995 | |
| JP | 07-089 077 | A2 | 4/1995 | |
| JP | 07-125 197 | A2 | 5/1995 | |
| JP | 07-156 407 | A2 | 6/1995 | |
| JP | 07-213 310 | A | 8/1995 | |
| JP | 07-241 983 | A2 | 9/1995 | |
| JP | 07-304 167 | A2 | 11/1995 | |
| JP | 07-314 694 | A2 | 12/1995 | |
| JP | 07-314 728 | A2 | 12/1995 | |
| JP | 07-323 657 | A2 | 12/1995 | |
| JP | 08-052 903 | A2 | 2/1996 | |
| JP | 08-118 617 | A2 | 5/1996 | |
| JP | 08-164 602 | A2 | 6/1996 | |
| JP | 08-174 995 | A2 | 7/1996 | |
| JP | 08-187 933 | A2 | 7/1996 | |
| JP | 08-216 395 | A2 | 8/1996 | |
| JP | 08-259 868 | A2 | 10/1996 | |
| JP | 08-267 733 | A2 | 10/1996 | |
| JP | 08-309 987 | A2 | 11/1996 | |
| JP | 09-031 866 | A2 | 2/1997 | |
| JP | 09-039 233 | A2 | 2/1997 | |
| JP | 2 593 830 | B2 | 3/1997 | |
| JP | 09-057 966 | A2 | 3/1997 | |
| JP | 09-066 661 | A2 | 3/1997 | |
| JP | 2 618 359 | B2 | 6/1997 | |
| JP | 09-175 004 | A2 | 7/1997 | |
| JP | 09-175 005 | A2 | 7/1997 | |
| JP | 09-175 006 | A2 | 7/1997 | |
| JP | 09-175 007 | A2 | 7/1997 | |
| JP | 09-194 781 | A2 | 7/1997 | |
| JP | 09-226 229 | A2 | 9/1997 | |
| JP | 09-240 138 | A2 | 9/1997 | |
| JP | 09-268 482 | A2 | 10/1997 | |
| JP | 09-268 484 | A | 10/1997 | |
| JP | 09-286 102 | A2 | 11/1997 | |
| JP | 09-314 984 | A2 | 12/1997 | |
| JP | 10-034 967 | A2 | 2/1998 | |
| JP | 10-044 408 | A2 | 2/1998 | |
| JP | 2 732 999 | B2 | 3/1998 | |
| JP | 2 758 788 | B2 | 5/1998 | |
| JP | 10-138 504 | A2 | 5/1998 | |
| JP | 10-138 510 | A2 | 5/1998 | |
| JP | 10-138 516 | A2 | 5/1998 | |
| JP | 10-138 520 | A2 | 5/1998 | |
| JP | 10-138 521 | A2 | 5/1998 | |
| JP | 10-193 610 | A2 | 7/1998 | |
| JP | 10-264 498 | A2 | 10/1998 | |
| JP | 10-278 312 | A2 | 10/1998 | |
| JP | 11-010 852 | A2 | 1/1999 | |
| JP | 11-010 853 | A2 | 1/1999 | |
| JP | 11-061 021 | A2 | 3/1999 | |
| JP | 10-099 646 | A2 | 4/1999 | |
| JP | 11-188 968 | A2 | 7/1999 | |
| JP | 11-207 951 | A2 | 8/1999 | |
| JP | 11-268 284 | A2 | 10/1999 | |
| JP | 11-268 405 | A2 | 10/1999 | |
| JP | 11-277 772 | A2 | 10/1999 | |
| JP | 2000-000 266 | A | 1/2000 | |
| JP | 2000-043 401 | A2 | 2/2000 | |
| JP | 2000-052 640 | A2 | 2/2000 | |
| JP | 2000-127 611 | A2 | 5/2000 | |
| JP | 2000-190 628 | A2 | 7/2000 | |
| JP | 2000-203 150 | A2 | 7/2000 | |
| JP | 2000-233 571 | A2 | 8/2000 | |
| JP | 3 089 308 | B2 | 9/2000 | |
| JP | 3 089 583 | B2 | 9/2000 | |
| JP | 2000-238 410 | A2 | 9/2000 | |
| JP | 2000-256 974 | A2 | 9/2000 | |
| JP | 2000-296 670 | A | 10/2000 | |
| JP | 2001-010 031 | A2 | 1/2001 | |
| JP | 2001 018 518 | A2 | 1/2001 | |
| JP | 2001 020 185 | A2 | 1/2001 | |
| JP | 2001 039 017 | A2 | 2/2001 | |
| NL | 9400024 | A | 8/1995 | |
| WO | 95/02973 | | 2/1995 | |
| WO | WO 95/15410 | | 6/1995 | |
| WO | 96/31345 | | 10/1996 | |
| WO | WO 97/18090 | | 5/1997 | |
| WO | WO 98/43821 | | 10/1998 | |
| WO | WO 99/33669 | | 7/1999 | |
| WO | WO 99/43760 | | 9/1999 | |
| WO | WO 99/55269 | | 11/1999 | |
| WO | WO 99/55270 | | 11/1999 | |
| WO | WO 99/55271 | | 11/1999 | |
| WO | WO 99/60973 | | 12/1999 | |
| WO | WO 99/65700 | | 12/1999 | |
| WO | WO 00/07426 | | 2/2000 | |
| WO | WO 00/35401 | | 6/2000 | |
| WO | WO 00/40195 | | 7/2000 | |

| | | |
|---|---|---|
| WO | WO 00/40196 | 7/2000 |
| WO | WO 00/42960 | 7/2000 |
| WO | WO 00/56972 | 9/2000 |
| WO | WO 00/69950 | 11/2000 |
| WO | WO 00/72984 | 12/2000 |
| WO | WO 00/73063 | 12/2000 |
| WO | WO 00/76441 | 12/2000 |
| WO | WO 01/02254 | 1/2001 |
| WO | 01/03529 | 1/2001 |
| WO | WO 01/27382 | 4/2001 |
| WO | WO 01/31122 | 5/2001 |
| WO | WO 01/31124 | 5/2001 |
| WO | WO 01/32318 | 5/2001 |
| WO | WO 01/36171 | 5/2001 |
| WO | WO 01/36209 | 5/2001 |
| WO | WO 01/49230 | 7/2001 |
| WO | WO 01/50412 | 7/2001 |
| WO | WO 02/14080 | 2/2002 |
| WO | WO 02/051644 | 7/2002 |
| WO | 03/037121 | 5/2003 |

OTHER PUBLICATIONS

Material Safety Data Sheet; Hot Melt Ink, Cyan, Magenta, Yellow, etc.; pp. 1–3.

Material Safety Data Sheet; Hot Melt Ink, Black, High; JET 7520/JET 7533; pp. 1–4.

Sales Literature; Oct. 1, 2002; Spectra Inc.; "Galaxy PH 256/80 HM".

Hydrophobic Surfaces, edited by F.M. Fowkes of the Academic Press, New York, 1969, pp. 1–27.

* cited by examiner

HIGH-SPEED INKJET PRINTING FOR VIBRANT AND CROCKFAST GRAPHICS ON WEB MATERIALS OR END-PRODUCTS

BACKGROUND OF THE INVENTION

Drop on demand piezo ink jet printing apparatus have been used to apply inks to a variety of substrates for a period of time. Generally, a drop on demand piezo ink jet printing apparatus operates to discharge individual droplets of ink onto a substrate in a predetermined pattern to be printed. Such an apparatus typically incorporates an array of orifices in a nozzle block, a plurality of control printheads, and a controller. The orifices are customarily arranged in a vertical row, and conventional ink jet printing apparatus have incorporated a separate printhead communicating with each orifice. The printheads are controlled by the controller, which can be keyed by an operator to operate the printhead according to a programmed schedule to print one or a series of characters or symbols.

Each orifice is designed to emit a single droplet of ink during each firing of its associated printhead. The droplets, emitted according to the programmed sequence, are directed toward a substrate where the character or symbol is printed. The quality of print produced by a drop on demand ink jet printer requires among other things, precise control over the size of the ink dot that impacts the substrate. Dot size in turn is affected by the size of an ink droplet discharged from a nozzle.

In the past, it was important in the overall design represented by the relationship between printhead characteristics, orifice size, and ink characteristics, that the droplets not only be of proper size but also that the size be consistent because otherwise the printed characters or symbols would be irregular in width. Of course the substrate or material may also affect the resulting image.

Admittedly, there has been much progress in the area of piezo jet printing however, heretofore, the piezo jet printers were limited in that they were not able to handle high-speed process printing. The inability of prior devices to perform the high-speed printing was due in part to the inability of the inks being processed to dry fast enough. That is, previously, the inks used were not adequately drying and therefore were not achieving or maintaining the registration necessary. Thus, prior attempts to process printing at high-speeds resulted in or caused a degradation of image quality, if any image was obtainable.

Furthermore, until recently, piezo jet printheads capable of processing inks and other compositions at high frequencies were not available. The evolution of printhead design has resulted in an ink jet device which is capable of high-frequency operation in accordance with the present invention. However, the mere ability to operate at high frequencies does not provide for processing of all inks and compositions, and has not heretofore provided the ability to maintain the registration of the printings, especially where the printer is operated at high frequency while the material is passed thereunder at high speeds. For it is one thing to operate at a high frequency or at high speed and quite another to operate at high frequency and high speed.

Thus there is a need for a process in which recently developed printheads may be used to provide high-speed process printing of materials.

While many improvements to conventional ink jet printing apparatus have been made, the piezo jet printing apparatus currently available lack the ability to create multi-color process images at high speeds, let alone in a single pass of the apparatus across the substrate (or a single pass of the substrate past the apparatus). There also remains a need for a substrate upon which high-speed process printing occurs yet the material is able to achieve a level of crockfastness higher than previously achieved under those printing conditions.

SUMMARY OF THE INVENTION

Personal care articles are currently printed off-line with typical contact printing techniques, and solvent or aqueous based inks. The existing printing approach represents an added processing step for the material which is printed thereby creating increased cost and added waste. The inks used for classic printing techniques also require drying steps that have been prohibitive at cost effective production speeds. Contact printing with prior ink systems is ultimately incapable of operating efficiently at line speeds typical for personal care product converting machines. As such the cost associated with slowing production to enable contact printing frequently restricts the amount of printing that is affordable in disposable personal care products. For these reasons, the printing of personal care products and the like on a converting line has been technologically limited.

The present invention provides a means to deliver acceptable graphics on personal care products and the like in an affordable manner, while reducing overall production cost, equipment, waste, and inefficiency.

The present invention relates to a method of creating multi-color process images at high speed. The method includes (i) providing at least two high operating frequency printheads, the high operating frequency printheads being capable of processing phase-change inks; (ii) providing at least two phase-change inks; (iii) providing a substrate; (iv) activating the printheads such that at least two inks pass therethrough; and (vi) passing the substrate under the printheads at a rate of at least about 1000 feet per minute; wherein at least one process image is formed on the substrate. In one embodiment of the method of the present invention the printheads may have operating frequencies of at least about twenty kHz. It is desirable for the phase-change inks to be hot-melt phase-change inks. In another embodiment of the invention the inks may be wax-based.

In yet another embodiment, the present invention is directed to a process for achieving high-speed crockfast process printing on a material with phase-change ink. The process includes (i) providing at least an array of printheads capable of processing phase-change inks at frequencies of at least about 20 kHz; (ii) providing a material; (iii) providing a material transport system capable of transporting or conveying the material under the printheads; (iv) providing a plurality of phase-change inks; (v) transporting the material under the array of printheads at a speed of at least 1000 ft/min; and (vi) ejecting ink from at least two of the printheads onto the material so as to form, at least in part, a process image. The step of ejecting ink may include registered placement of the ink. Depending on the frequency at which the printheads are operated, the step of ejecting ink may form an image having up to about 200 drops/printhead/linear inch. In other embodiments the ink may form an image having only up to about 100 drops/printhead/linear inch. The ink may be selectively applied to all or a portion of the substrate, may be applied to the substrate in a pattern and/or may be applied to the substrate so as to create a topography. In one embodiment the plurality of inks may include inks of at least two different colors. In another embodiment the image formed on the material may be a multi-color image. Still yet another embodiment of the process may further include a control element; wherein the control element is in communication with at least one array of printheads; and wherein the control element regulates the at least one array of printheads such that the inks are ejected onto the material in registered placement.

DEFINITIONS

Figure 1:
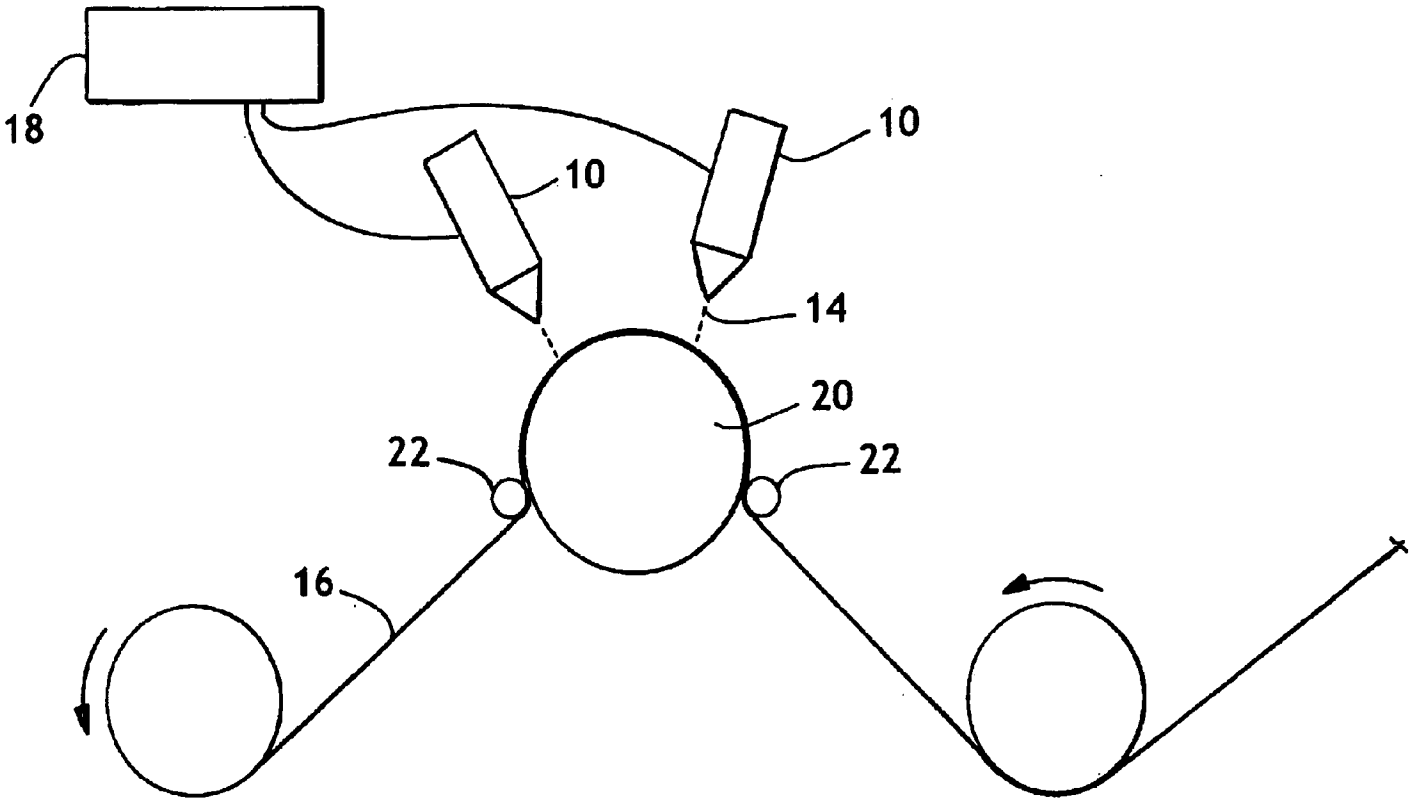
FIG. 1 is a schematic diagram of an exemplary process of the present invention.

As used herein, the terms "chemistry" or "chemistries" are intended to include and refer to any and all applications, inks (other than phase-change inks), compositions, formulations, and the like (including those having solids and/or particulates) which may be processed by the printheads described herein in accordance with the present invention. It is desirable, but not necessary, that the terms "chemistry" or "chemistries" be directed to such applications, inks, compositions, formulations, and the like which are compatible with phase-change inks. Suitable chemistries include, but are not limited to, medicaments, inks, waxes, paints, lotions, ointments, skin health agents, topical applications, and the like or combinations thereof. It will be appreciated that one of such chemistries may be a medium which is used to carry or transport the phase-change inks. Exemplary mediums include, but are not limited, low molecular weight linear polyethylenes.

As used herein, the terms "comprises," "comprising" and other derivatives from the root term "comprise" are intended to be open-ended terms that specify the presence of any stated features, elements, integers, steps, or components, but do not preclude the presence or addition of one or more other features, elements, integers, steps, components, or groups thereof.

As used herein, the term "fabric" refers to all of the woven, knitted and nonwoven fibrous webs, as well as paper, foam, film or the like.

As used herein, the term "health care product" means medical gowns, drapes, clothing, as well as devices which may be used in a medical procedure.

As used herein, the term "ink" refers to phase-change inks.

As used herein, the term "layer" when used in the singular can have the dual meaning of a single element or a plurality of elements.

As used herein the term "meltblown fibers" means fibers formed by extruding a molten thermoplastic material through a plurality of fine, usually circular, die capillaries as molten threads or filaments into converging high velocity, usually hot, gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Butin et al. Meltblown fibers are microfibers which may be continuous or discontinuous, are generally smaller than 10 microns in average diameter, and are generally tacky when deposited onto a collecting surface.

As used herein the terms "nonwoven" and "nonwoven fabric or web" mean a web having a structure of individual fibers, filaments or threads which are interlaid, but not in an identifiable manner as in a knitted fabric. Nonwoven fabrics or webs have been formed from many processes such as for example, meltblowing processes, spunbonding processes, and bonded carded web processes. The basis weight of nonwoven fabrics is usually expressed in ounces of material per square yard (osy) or grams per square meter (gsm) and the fiber diameters useful are usually expressed in microns. (Note that to convert from osy to gsm, multiply osy by 33.91).

As used herein, the term "personal care product" or "personal care absorbent product" means diapers, training pants, swim wear, absorbent underpants, baby wipes, adult incontinence products, sanitary wipes, wet wipes, feminine hygiene products, wound dressings, nursing pads, time release patches, bandages, mortuary products, veterinary products, hygiene and absorbent products and the like.

As used herein, the term "phase-change" application, chemistry, ink, liquid, material or the like refers to a material which is processed in a liquid or substantially liquid state and then solidifies, returns to its natural state when cooled, cures, cross-links, or the like.

As used herein the term "spunbonded fibers" refers to small diameter fibers which are formed by extruding molten thermoplastic material as filaments from a plurality of fine, usually circular capillaries of a spinneret with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, and U.S. Pat. No. 3,542,615 to Dobo et al. Spunbond fibers are generally not tacky when they are deposited onto a collecting surface. Spunbond fibers are generally continuous and have average diameters (from a sample of at least 10) larger than 7 microns, more particularly, between about 10 and 20 microns.

These terms may be defined with additional language in the remaining portions of the specification.

As used herein a singular term generally includes the plural, and a plural term generally includes the singular unless otherwise indicated.

DESCRIPTION OF TEST METHODS

Crockfastness in the intended use of the product refers to the transfer resistance of ink from the printed substrate to another (e.g. apparel) in contact with the product. A modification of ASTM test method F 1571–95 using a Sutherland Ink Rub Tester was used to determine the crockfastness of the materials of the present invention. The ASTM test method was modified in that two 1"×2" rubber pads (available from the DANILEE COMPANY) were applied at the ends (one pad at each end) of the bottom surface of the weight so that a stress of 1 pound per square inch (psi) was achieved across the pads. The second modification of the standard ASTM test method was that instead of using a microcloth available from Buehler, a 80×80 count bleached muslin cloth, Crockmeter Cloth #3 (available from Testfabrics, Inc., having offices in Pennsylvania), was used to rub against the printed material. It is of note that the ASTM is identified as being intended to present a procedure for measuring the abrasion resistance and smudge tendency of typewritten and impact written images; however, in the modified test method it was used to test images produced by an ink-jet printer. The procedure was also modified such that the tester ran for 40 cycles, rather than 10. The modified method also includes a visual comparison of the color which was transferred onto the muslin cloth to the AATCC 9-Step Chromatic Transference Scale (1996 Edition) (available from American Association of Textile Chemists and Colorists, having offices in Research Triangle Park, N.C.) so as to determine a crockfastness rating between 1 and 5. A rating of 5 indicates no transfer of color on the muslin cloth.

DETAILED DESCRIPTION OF THE INVENTION

The present invention relates to a method of creating multi-color process images at high speed. The method includes providing at least two high-operating frequency printheads 10 (FIG. 1) which are capable of processing phase-change inks, providing at least two phase-change inks 14, providing a substrate 16, activating the printheads such that at least two inks pass therethrough, and passing the substrate 16 under the printheads at a rate of at least about 1000 feet per minute, wherein at least one process image (not shown) is formed on the substrate 16. In one embodiment of the method of the present invention the printheads may have operating frequencies of at least about twenty kHz. Any suitable printhead may be used provided it is capable of performing at the frequencies identified with any one or more of the phase-change inks discussed herein. It is desirable for the phase-change inks to be hot-melt phase-change inks, and in some instances more desirable for the phase-change inks to be wax based.

While reference is made throughout the disclosure to passing, conveying or transporting the substrate or material under the printhead, that same terminology is also intended to include passing the printhead over the substrate or the combined movement of the printhead and the material such that the desired production speeds may be achieved.

As discussed in more detail herein, the use of phase-change inks, specifically hot-melt inks, and more specifically wax-based inks enables the high speed printing desired herein as the phase-change inks do not require drying. Previously, the drying time of inks and compositions used in printers limited production speeds. The use of phase-change inks eliminates the need for additional drying steps and/or space between the printheads which was previously necessary. Thus the desired registration and image quality can be obtained at high speeds.

The image produced in accordance with the process and methods discussed herein may also be the result of the fluid handling properties of the printheads of some of the suitable devices. That is, the ability of some of the printheads to provide for the degassing of the inks further enables the high frequency jetting as there may be less disruption in the supply of inks to the printheads. Thus, it has been determined that the combination of the phase-change inks and the ability to degas those inks during processing may provide enhanced results. In fact, printhead operation frequencies higher than those previously known are achievable as a result.

In a further embodiment, the method may include providing a controller or a control means 18 (FIG. 1), wherein the control means is in communication with the printheads. The control means 18 is desirably capable of operating in multiple modes and may control the printheads 10 such that the printheads 10 act together or independently from one another. It will be appreciated that any number of control means are suitable for use with the present invention depending in part upon the number of printheads each control means is in communication with. Exemplary control means may vary from manual to computer controlled or computer regulated control elements (e.g. manual switches, line driven switches, photo-optic sensors, and software driven switching circuits).

Also illustrated in FIG. 1 as part of the material transport system is a drum 20 and a plurality of idlers 22. The drum 20 and idlers 22 are designed to be compatible with the material 16 which is passing thereover such that the material 16 is in a substantially wrinkle-free fashion or position as it passes over or around the drum 20. The idlers 22 may be adjusted such that a desired level of tension may be applied to the material to eliminate or reduce the wrinkles which might otherwise be present in the material 16 were it to pass over or about the drum 20 without having some tension force applied thereto. That is, the idlers 22 may be used to create or maintain a desired tension on the material 16 as it passes over or about the drum 20. It will be appreciated and understood that while a drum 20 is shown in FIG. 1 and claimed herein, the present application is not intended to be limited thereto, and that the term is intended to mean or include, but not be limited to, any and all surfaces over which the material which is to be printed upon may pass such that the material is suitable for printing thereon as it passes over or about the surface. Additionally, while reference is made to a plurality of idlers 22, it is also intended for the scope of the present invention to include any other suitable means which may be used to maintain or adjust the tension on the material as the material passes under the printheads. Further, it will be appreciated that while the distance or spacing between the printheads and the material onto which they are to print may vary, however, it is desirable for the material to be about 2 mm to about 3 mm from the printhead when the ejection or printing of ink occurs. It will be further appreciated that when a drum and idler set or the like is used as part of the system used to transport the material, that the printheads may be positioned about the printhead in a desired fashion such that the gap or spacing between the printhead and the material passing over the drum is a desired distance. It will be appreciated that the use of a drum or the like will enable the printing of more consistent images as the distance between the printhead and material can be maintained at a relative constant.

In one embodiment of the method of the present invention the inks and/or chemistries applied to the material or substrate may have varying degrees of penetration into the material, such that the varying degrees of ink and/or chemistry penetration may result in a material having a variety of topographies. As will be appreciated, the degree of penetration may vary in part because of the temperature at which the inks and/or the medium, if any, they are in are processed, the material to which the inks are applied and/or the composition of the inks and/or the medium, if any, in which they are in. Thus, for example, where the material is receptive to penetration, if the inks are passed through one or more of the printheads at a temperature of at least about 115° C., as desired, the penetration can generally be expected to greater than at cooler temperatures.

In another embodiment of the invention the one or more inks may be selectively applied to all or a portion of the substrate. The inks may be applied to the substrate in a image or pattern which is repeating or random and may also be applied to the substrate so as to produce a fluid barrier. As will be discussed in more detail below, at least two of the inks will be applied in such a manner on at least a portion of the material or substrate so as to form a process image; however, on any or all of the other portions of the material, the inks and/or chemistries may be applied such that the discrete segments thereof are overlapping or contiguously placed, and/or, in some instances, interconnected (i.e. formed of discrete droplets which merge or combine) to form discrete domains or regions. The discrete segments, and especially those which are contiguously placed, may produce or create areas or domains of the substrate having, for example, fluid barrier properties, channeling characteristics, etc. in addition to or separate from their image application. Another embodiment of the material of the present invention provides that the topography of chemistries can enable improved fluid management and/or skin separation.

Although it is generally desired for the inks to remain in place on the receiving material or substrate after placement (i.e. non-releasable), there may be instances when it is desirable for at least a portion of the ink to be releasable. Alternately, there may be instances when the inks remain in place but one or more of the chemistries which were processed with the phase-change inks may be releasable. Thus, while it may be desirable in one or more embodiments for the inks to remain in place and/or exhibit a higher level of crockfastness, where the inks are processed in a medium or the like, one or more of the chemistries may release from the substrate or other chemistries when exposed to certain conditions or upon the happening of certain events (e.g. exposure to certain temperatures (e.g. at least about body temperature (about 23° C.), insult, etc.)). It is further contemplated that the release of one or more chemistries from the substrate may cause or result in triggered degradation of all or portion of the product or substrate. That is, a resulting product may be designed such that degradation begins or is initiated upon the release of one or more inks and/or chemistries of the product.

As suggested above, the method of the present invention includes the step of providing a substrate upon which the discharged inks and/or chemistries may form discrete droplets or segments thereon. While it is desirable in at least one embodiment of the present invention that the material be a porous material, and more desirably a polyolefin, the methods and processes of the present invention, contemplate the use of any suitable porous or non-porous material. The suitability of a particular material may depend, at least in part, on the inks and/or chemistries being used in conjunction therewith. Exemplary materials include, but are not limited to, wovens, nonwovens, papers, foams, films, tissues, metals, plastics, glass, laminates, and generally any surface of any substrate or product which is capable of having the inks or inks and chemistries described herein applied thereto either in the manner described or so as to produce materials such as those discussed herein. It is further contemplated that the material may comprise or be incorporated in a flexible packaging product, an article of clothing, a health care product, a personal care product, one or more components thereof, and the like.

Combinations of four basic colors (e.g., Cyan, Magenta, Yellow and Black) can be used to create a very broad multi-color spectrum thereby utilizing significantly fewer printheads and colorbanks than past processes. This approach not only reduces the equipment cost and the number of inks needed to be kept in inventory, but also reduces the amount of converting equipment needed, the amount of floor space occupied, as well as time costs associated with color change overs as compared with prior contact printing devices. While the four color combination specified above has been found to be simplistic yet flexible enough to accommodate the graphic requirements discussed herein, a variety of other color combinations are known to work. Exemplary combinations include those having just one color as well as those with up to 12 colors which allows for the production of a broader range of colors with more intense color concentrations. It is appreciated that more than 12 colors of ink may be used in a combination, however, the size of the drum(s) used in manufacture, the number of printheads, and/or color banks necessary to accommodate the different inks may necessitate a limit on the number of colors ultimately used.

It will be appreciated that inks which are suitable for use in the present invention may be available in a variety of colors, and it is desirable that inks of at least two different colors are used. Furthermore, where inks and/or chemistries of different colors are used in the above methods and processes, the resulting pattern or image formed on the material may be such that a single or multi-color image is produced. That is, for example, where yellow and blue inks are used, the resulting image could be green or it could be yellow and blue or it could be green, yellow and blue. Of course a variety of shades of each color is also possible to produce.

While not specifically directed thereto, the method of the present invention may be achieved at least in part by an apparatus arranged so as to provide for process printing. That is at least two printheads should be positioned such that the resulting emissions or discharges therefrom overlap at least in part so as to create a process image. Any number of printhead orientations are possible and all suitable configurations are contemplated for use in the present invention. While the basics of process printing (as suggested in the Pocket Guide to Color Reproduction Communication & Control, by Miles Southworth (1972)) are known to those having skill in the art, the ability to process print at high production speeds, at high-printhead frequency, and/or on some of the materials discussed herein is not know to those having skill in the art. Heretofore, it was also unknown to print with phase-change inks at the operating conditions described herein.

In a further embodiment of the present invention, the method may include the provision of a temperature sensor, wherein the temperature sensor measures, and optionally allows for the control of, the temperature of the inks and/or chemistries which pass through the printheads used. It will be appreciated that more than one sensor may be used where multiple inks and/or chemistries are used with the inkjet printing device.

It will be appreciated that the methods and processes discussed herein will result in the discharge of discrete segments of inks and/or chemistries, and while discrete segments of many sizes are contemplated, the discrete droplets or segments will desirably have a volume of between about 5 picoliters (or nanograms) and about 100 picoliters, more desirably between about 20 picoliters and about 90 picoliters, and even more desirably between about 50 picoliters and about 80 picoliters. The droplets or segments will also desirably have a length and width less than about 5 mm, more desirably less than about 3 mm, and still more desirably less than about 2 mm and greater than about 0.02 mm. The discrete segments are desirably discharged at a frequency of at least 20 kHz, and more desirably between about 20 kHz and about 40 kHz. Furthermore, inks and chemistries having a vast range of the viscosities may be processed in accordance with the methods and processes suggested and described in more detail herein. It is desirable for the viscosity of the inks and/or chemistries discharged from the printheads to be between about 5 and about 50 centipoise and more desirably between about 8 and about 30 centipoise at the time of discharge (at an elevated jetting temperature). Additionally, as the printheads generally operate at drive voltages within a broad range, it will be appreciated and understood that manipulation of the voltages at which the printheads are operated can provide for operation of the printheads at higher frequencies while still maintaining the desired drop size or volume and thus accommodate higher material line or processing speeds.

Although droplets or discrete segments of particular cross-sectional shapes, dimension or volume are contemplated and desired in certain embodiments, in those embodiments not requiring specific droplet size or shape, any variety of cross-sectional shapes of the droplets are contemplated for use on or in the material of the present invention. The cross-sectional shape of the droplets which solidify, return to their normal state under ambient conditions, cure, crosslink, etc. on or below the surface of the substrate may be changed or controlled, at least to some degree, depending on the selection of the chemistries to be applied to the selected substrate as well as the apparatus or method selected for application. Specifically, for example, the cross-sectional shape of the droplets which solidify on or below the surface of the substrate may be changed, by manipulating, for example, the temperature, velocity, and throw distance. Thus, for example, if the temperature of the ink or chemistry is increased, it will typically penetrate further into the substrate before solidifying, thereby resulting in a more dome-shaped deposit having less height than one formed at a lower temperature. As an alternative to increased or higher penetration, the manipulation of temperature can also result in better fusing between the ink and the substrate (especially thermoplastics) so that there is better adhesion of the ink. Of course, depending on the intended function of the domes (e.g. liquid barrier, fluid management, skin separation, aesthetics, etc.), and whether the application is intended to be permanent or releasable, the desired makeup, including, but not limited to, weight, shape and composition of the discrete segments applied should be carefully selected.

It will be recognized that the inks and/or chemistries which are used have a temperature at which they begin to degrade. The temperature at which degradation occurs will vary depending on the inks and/or chemistries used and care should generally be used not to exceed the degradation temperature during processing; however, it is contemplated that there may be one or more instances in which partial degradation produces a desired characteristic.

Although not necessarily the case, depending on the inks and materials which are selected for use with each other, a higher level of penetration may lead to a higher level of crockfastness. While crockfastness is not necessarily dependent on the level of penetration (as there may also be, for example, chemical bonding or interaction which contributes to the crockfastness), where an ink achieves a higher degree of penetration within a material the more likely some or all of the ink is to remain in place. It is desirable for the inks in images produced in accordance with the processes and methods described and discussed herein to achieve a crockfast rating of at least about 4 in accordance with the procedure described above.

In yet another embodiment, the present invention is also directed to a process for achieving high-speed crockfast process printing on a material with phase-change ink. The process including (i) providing at least an array of printheads capable of processing phase-change inks at frequencies of at least about 20 kHz; (ii) providing a material; (iii) providing a material transport system capable of transporting the material under the printheads; (iv) providing a plurality of phase-change inks; (v) transporting the material under the array of printheads at a speed of at least 1000 ft/min; and (vi) ejecting ink from at least two of the printheads onto the material so as to form, at least in part, a process image. The step of ejecting ink may include registered placement of the ink. Depending on the frequency at which the printheads are operated, the step of ejecting ink may form an image having up to about 200 drops/printhead/linear inch. In other embodiments the ink may form an image having up to about 100 drops/printhead/linear inch. The ink may be selectively applied to all or a portion of the substrate, may be applied to the substrate in a pattern or random fashion and/or may be applied to the substrate so as to create topography. As with the other embodiments, certain topographies may provide or produce skin health benefits. The application of inks and/or chemistries so as to produce topography on a substrate can provide a final product or component thereof which exhibits improved fluid management and/or skin separation during use.

The plurality of inks should include inks of at least two different colors. In another embodiment the image formed on the material may be a multi-color image. Still yet another embodiment of the process may further include a control element, wherein the control element is in communication with at least one array of printheads, and wherein the control element regulates at least one array of printheads such that the inks are ejected onto the material in registered placement.

It will be appreciated that a piezo jet printer, amongst others, may be suitable for use in connection with the methods and processes described herein. As such, the step of ejecting or discharging the ink and/or chemistries from the at least one printhead may include firing or triggering one or more of the at least one printheads. The process may also include the provision of a control element or control means, wherein the control element is in communication with one or more of the at least one printheads. The control element allows one or more of the printheads to be regulated in such a manner so as to permit the ink and/or chemistries which are ejected or discharged therefrom onto the substrate to be deposited so as to create or generate a pattern.

The control element may also provide for real-time adjustment of the discharge from at least one of the printheads. Real-time adjustment allows or provides for the immediate or essentially instantaneous control or change in the operation of the printing apparatus of the present invention. The speed at which an apparatus used in connection with the present invention may be adjusted is generally limited by the time equal to about one-half of the minimum period of firing or pulse period associated with the printheads of the apparatus. That is, the minimum pulse or firing period is the shortest time it takes for the printhead in question to change from a firing or discharging position and return to that same position, or, stated another way, the minimum pulse or firing period is the shortest time required for a printhead to cycle between firings or ejections. As the operation speed of printheads suitable for use in the present invention continues to increase, so too will the firing or discharge frequency resulting in a decreased pulse period. All such developments are contemplated by the present invention.

Real-time control may also be combined with one or more sensors located along the machines being used to produce a product or component thereof such that changes in the pattern, amount, position, etc. of the inks and/or chemistries may be made. Real-time changes in the operation of a printhead or an array of printheads may be beneficial if multiple sizes or shapes of materials are being processed by the printing apparatus such that different patterns, applications, orientations thereof and the like are desired depending on the product or component being processed. The precise control of this system provides extreme graphics flexibility that can be used to make substantially instantaneous graphics changes during production, creating the opportunity to introduce new features such as variety packs, or seasonal graphics with the push of a button, not possible with typical printing techniques. The ability to have real-time control or "shift on the fly" production changes may result in significant production improvements when compared to previous process printing techniques which used fixed printing patterns, such as those found on rotogravure printing rolls, and which require production downtime associated with the replacement of the rolls each time a pattern or product was changed.

Additionally, the use of computer generated print designs or computer operated print heads allows for nearly limitless design configurations and applications. A computer program may be configured to use mathematic requirements particular to the substrate, inks and/or chemistries, such as capillary size, length, pressure, degradation temperatures, etc, to design a resulting material. Once created, a design may be accurately produced on the substrate by inkjet printing in accordance with the present invention.

Because the image patterns may be digitally generated, they are infinitely variable and instantly changeable. The use of phase-change inks as discussed herein further enhances the number of possible patterns which may be suitable and can enable process printing at speeds and with certain materials or substrates which have heretofore been unsuitable or unobtainable. That is, the use of phase-change inks can enable different substrate penetration or adhesion to a material than previously obtainable with non-phase-change inks. Accordingly, higher crockfastness ratings which have been heretofore unobtainable may in some instances be achieved.

Further embodiments of the methods and processes of the present invention allow for the application of the desired inks and/or chemistries in one pass of the substrate past the printheads. The processes and methods of the present invention are able to achieve the printing described herein without the need for drying or chemical pre- or post-treatment of the material, inks or chemistries. The ability to print in a single pass without the need for pre-or post-treatment or drying provides for in-line production. That is, the material or substrate may be unwound, printed, and cut. Of course multi-stage production is also possible, however, it is generally less desirable.

Although, the process of the present invention is such that that it contemplates an array of printheads operating (e.g. having lengthier dwell times or having multiple rows of printheads, etc.) such that the printing may be accomplished in one pass of the printheads over the substrate or one pass of the substrate by the printheads, in some instances it may be desirable for the inks and/or chemistries, and hence the image, pattern, topography, the fluid management characteristics and the like, to be produced or achieved by multiple passes of the substrate past the printhead. As noted above, the processes and methods of the present invention generally do not require pre- or post-treatment, however, pre- or post-treatment is not excluded from the disclosure herein. Thus, the multiple pass approach may be desirable for a number of reasons including, but not limited to, those instances where it is desired to pre- or post-treat the material, ink or chemistries. Additionally, it may be desirable to produce a material via multiple passes of the substrate past the printhead where releasable treatments or chemistries are used such as those disclosed, for example, in commonly assigned U.S. patent application Ser. No. 09/938,347 to Yahiaoui et al.

While much of this disclosure speaks generally of printheads, and while any suitable printhead is contemplated hereby, a printhead which is suitable for use with the present invention is Spectra's printhead model Galaxy PH 256/80, a piezo-driven printhead available from Spectra, Inc., having offices in Lebanon, N.H. It has been determined that with Galaxy PH 256/80 printhead that it is desirable for the printhead to operate at voltages of between about 100 and about 200 volts, and more desirably between about 110 and about 185 volts, to achieve the drop mass size and consistency which are discussed herein. The above mentioned voltage ranges are not intended to be inclusive for all printheads, but rather are intended only as a desired range for the specific Spectra model mentioned above. As such any and all operating voltages which result in the drop mass consistency under the other operating conditions described herein are suitable and are contemplated by the present invention.

Additionally, although piezo-driven printheads have a variety of performance capabilities, such devices are typically capable of emitting droplets having a diameter in the range of about 50–90 micrometers with placement resolution to at least about 1/200 of an inch. It is contemplated that the processes and methods of the present invention could be used with any improvement in piezo-driven printheads or the like which provide for an increase in firing or printhead operating frequency, expansion of the range of droplet diameter and/or the placement resolution.

Examples of other suitable printheads include, but are not limited to, non-contact, drop-on-demand print heads such as those operating on piezo electric crystals and which are capable of operating in a range of about 20 to about 40 kHz range while delivering a drop size of up to about 80 ng. This capability enables the print head to discharge from about 20,000 to about 40,000 drops per second per nozzle. Operation of the printheads in this frequency range while implementing typical web or line speeds of at least about 1000 to about 2000 feet per minute (fpm) will result in the delivery of up to about 100 to 200 drops/hole/linear inch at at least about 1000 fpm, and up to about 100 drops/hole/linear inch at at least about 2000 fpm.

As a result of this discovery, resulting four-color process printed graphics can be delivered in-line at cost effective production speeds with minimal ink usage to materials such as those used in personal care products and the like. These graphics will generally consist of up to about 100 to about 200 drops per linear inch of any one color, and up to about 400 to about 800 drops per linear inch where a four-color combination is used.

[Note: Reference to drops per inch are intended to be drops per linear inch or drops per inch in the machine-direction, unless expressly indicated to the contrary. Further, unless expressly indicated to the contrary, reference to drops per inch are also per printhead or hole and thus per color.]

In sum, the present invention is directed to a method of delivering multi-color, registered graphics to materials, desirably personal care products, health care products and the like, by applying non-contact, drop-on-demand, phase-change inks at manufacturing line speeds typical of those products. While one would see or expect to see advantages of going to higher dots/drops per inch (dpi) in typical graphics media, with many substrates, such as those used in the production of disposable products (e.g. personal care products and the like), the higher dpi does not give the same perceived advantages. This is especially true with porous materials. Thus, as an increase in dpi does not necessarily provide appreciable differences in image quality. Thus, depending on the material or substrate selected for use, and especially so with substrates used in personal care products, it has been determined that by reducing the drop density of inks, delivering acceptable graphics for disposable products may be realized at an affordable delivery cost (e.g., capital/equipment, ink and manufacturing costs). That is the utilization of the higher frequency printheads while providing a reduction in the drops per inch used to produce the images on the substrate provides the opportunity to continue to operate at production speeds that are cost effective in industry yet still produce an image of appropriate quality while using less ink. That is, with some materials or end products it is acceptable to use a lower density (e.g. lower quality) graphic. As the lower density graphics are satisfactory, the increase in production speeds which can be achieved is significant in terms of production volumes and manufacturing costs.

While the invention has been described in detail with respect to specific embodiments thereof, those skilled in the art, upon obtaining an understanding of the invention, may readily conceive of alterations to, variations of, and equivalents to the described embodiments. It is intended that the present invention include such modifications and variations as come within the scope of the appended claims and their equivalents.

We claim:

1. A process for achieving high-speed crockfast process printing on a material with phase-change ink, the process comprising:

providing at least an array of printheads capable of processing phase-change inks at frequencies of at least about 20 kHz;

providing a material;

providing a material transport system capable of transporting the material under the printheads;

providing a plurality of phase-change inks;

transporting the material under the array of printheads at a speed of at least 1000 ft/min; and ejecting ink from at least two of the printheads onto the material so as to form an image having up to about 200 drops/printhead/linear inch.

2. The process of claim 1, wherein the material is porous.

3. The process of claim 1, wherein the step of ejecting ink comprises registered placement of the ink.

4. The process of claim 1, wherein the step of ejecting ink forms an image having up to about 100 drops/printhead/linear inch.

5. The process of claim 1, wherein the plurality of inks comprises inks of at least two different colors.

6. The process of claim 1 where the image formed on the material is a multi-color image.

7. The process of claim 1, further comprising a control element: wherein the control element is in communication with the at least one array of printheads; and wherein the control element regulates the at least one array of printheads such that the inks are ejected onto the material in registered placement.

8. The process of claim 1 further comprising:

a control element for regulating ink ejection from the printheads and for adjusting the speed at which the material is transported under the printheads.

9. The process of claim 8, wherein the ejection of ink is tied to the speed at which the material is transported under the printheads.

10. The process of claim 1 further comprising:

a control element for regulating ink ejection from the printheads;

a control element for controlling the transportation of material.

11. The process of claim 10, wherein the ejection of ink is tied to the material transport system.

12. The process of claim 1, wherein the inks are hot-melt phase-change inks.

13. The process of claim 1, wherein the inks are wax based inks.

14. The process of claim 1, wherein the material is a portion of a personal care product.

15. The process of claim 14, wherein the personal care product is selected from a diaper, training pant, absorbent underpant, adult incontinence product, sanitary wipe, wet wipe, feminine hygiene product, wound dressing, bandage, and mortuary and veterinary wipe, hygiene and absorbent product.

16. The process of claim 1, wherein the material is a portion of a health care product.

17. The process of claim 1, wherein the material is a portion of a flexible packaging product.

18. The process of claim 1 wherein the step of providing a material transport system capable of transporting the material under the printheads comprises a drum and a plurality of idlers such that the material is passed under the printheads in a substantially wrinkle-free fashion.

19. The process of claim 18 wherein a gap is located between the material and at least one of the printheads, and wherein the gap is about 1 mm to about 5 mm when the step of ejecting ink occurs.

20. The process of claim 1, wherein the material is a polyolefin.

21. The process of claim 1, wherein the inks pass through the printheads at temperatures of at least 115° C.

22. A process for achieving high-speed crockfast process printing on a material with phase-change ink, the process comprising:

providing at least an array of printheads capable of processing phase-change inks at frequencies of at least about 20 kHz;

providing a porous material;

providing a material transport system capable of transporting the material under the printheads;

providing a plurality of phase-change inks;

transporting the material under the array of printheads at a speed of at least 1000 ft/mm; and ejecting ink from at least two of the printheads onto the material so as to form an image;

wherein the step of ejecting ink forms an image having up to about 200 drops/printhead/linear inch.

23. The process of claim 22, wherein the step of ejecting ink forms an image having up to about 100 drops/printhead/linear inch.

24. A method of creating high-speed multi-color process images, said method comprising:

providing at least two high operating frequency printheads, said high operating frequency printheads being capable of processing phase-change inks at frequencies of about 20 kHz to about 40 kHz;

providing at least two phase-change inks;

providing a substrate;

activating the printheads such that at least two inks pass therethrough; and passing the substrate under the printheads at a rate of at least about 1000 feet per minute;

wherein at least one process image having up to about 200 drops/printhead/linear inch is formed on the substrate.

* * * * *

UNITED STATES PATENT AND TRADEMARK OFFICE

CERTIFICATE OF CORRECTION

PATENT NO. : 6,957,884 B2
DATED : October 25, 2005
INVENTOR(S) : Sharma et al.

It is certified that error appears in the above-identified patent and that said Letters Patent is hereby corrected as shown below:

Title page,
Item [73], Assignee, "Kinberly-Clark" should read -- Kimberly-Clark --.

Signed and Sealed this

Seventh Day of March, 2006

JON W. DUDAS
*Director of the United States Patent and Trademark Office*